US006832537B2

(12) United States Patent
Takabatake et al.

(10) Patent No.: US 6,832,537 B2
(45) Date of Patent: Dec. 21, 2004

(54) ROLL PAPER CUTTER

(75) Inventors: Yoshinari Takabatake, Tokyo (JP); Yukihiro Mori, Tokyo (JP); Fumio Sakurai, Tokyo (JP); Sho Chiba, Aizuwakamatsu (JP); Satoshi Segawa, Aizuwakamatsu (JP)

(73) Assignee: Nagano Fujitsu Component Limited, Susaka (JP)

( * ) Notice: Subject to any disclaimer, the term of this patent is extended or adjusted under 35 U.S.C. 154(b) by 218 days.

(21) Appl. No.: 09/989,057

(22) Filed: Nov. 21, 2001

(65) Prior Publication Data

US 2002/0148337 A1 Oct. 17, 2002

(30) Foreign Application Priority Data

Apr. 17, 2001 (JP) ..... 2001-118471

(51) Int. Cl.[7] ..... B26D 1/39; B41J 11/70

(52) U.S. Cl. ..... 83/614; 83/508; 83/596

(58) Field of Search ..... 83/614, 508, 596, 83/422, 455, 488, 414, 582, 489, 496, 479, 698, 578, 482, 90, 97, 89, 95, 167, 84–87, 698.41, 564, 485

(56) References Cited

U.S. PATENT DOCUMENTS

| | | | | | |
|---|---|---|---|---|---|
| 1,629,560 | A | * | 5/1927 | Webster | 12/57.5 |
| 1,796,463 | A | * | 3/1931 | Kaltenbach et al. | 30/240 |
| 1,876,075 | A | * | 9/1932 | Reichert, Sr. et al. | 30/240 |
| 2,648,904 | A | | 8/1953 | Brooks et al. | |
| 3,562,907 | A | * | 2/1971 | Greenberg | 30/233 |
| 4,414,874 | A | * | 11/1983 | Barnes et al. | 83/488 |
| 4,525,088 | A | * | 6/1985 | Shipos et al. | 400/621 |
| 4,665,787 | A | * | 5/1987 | Arnold et al. | 83/485 |
| 4,871,156 | A | * | 10/1989 | Kozyrski et al. | 269/303 |
| 4,979,838 | A | * | 12/1990 | Yokota et al. | 400/621 |
| 5,307,716 | A | * | 5/1994 | Onishi et al. | 83/488 |
| 5,881,623 | A | * | 3/1999 | Otani et al. | 83/455 |
| 5,904,085 | A | | 5/1999 | Onishi et al. | |
| 5,911,530 | A | * | 6/1999 | Hinojosa et al. | 400/621 |
| 5,937,723 | A | * | 8/1999 | Kirikoshi et al. | 83/614 |
| 6,135,001 | A | * | 10/2000 | Miazga et al. | 83/508 |
| 6,240,645 | B1 | * | 6/2001 | Ozeki | 30/294 |
| 6,302,605 | B1 | * | 10/2001 | Kanbe | 400/621 |
| 2001/0039866 | A1 | * | 11/2001 | Kohda et al. | 83/487 |

FOREIGN PATENT DOCUMENTS

| | | |
|---|---|---|
| DK | 489 354 | 1/1930 |
| JP | 1-308661 | 12/1989 |
| JP | 03196996 | 8/1991 |
| JP | 08150593 | 6/1996 |
| JP | 08174472 | 7/1996 |
| JP | 09029687 | 2/1997 |
| JP | 10076496 | 3/1998 |
| JP | 2000-296496 | 10/2000 |

OTHER PUBLICATIONS

Patent Abstracts of Japan for Publication No. 08085095 dated Apr. 2, 1996.

* cited by examiner

*Primary Examiner*—Allan N. Shoap
*Assistant Examiner*—Ghassem Alie
(74) *Attorney, Agent, or Firm*—Staas & Halsey LLP

(57) ABSTRACT

A roll paper cutter, for cutting roll paper which is fed out from a roll of paper so that it can be separated from an outer circumference of the roll of paper, comprises: a rail extending in the longitudinal direction of the rail perpendicular to the roll paper feeding direction; a stationary knife fixed at and supported by a carriage moving along the rail in the longitudinal direction of the rail; and a rotary knife pivotally supported by the carriage and rotated coming into contact with the stationary knife when the carriage is moved. When the carriage is moved in the longitudinal direction of the rail, a cutting edge intersection formed by the rotary knife, which is rotated by the movement of the carriage, and also formed by the stationary knife crosses and cuts the roll paper in the width direction.

12 Claims, 5 Drawing Sheets

ROLL PAPER CUTTER

BACKGROUND OF THE INVENTION

1. Field of the Invention

The present invention relates to a roll paper cutter for cutting roll paper.

2. Description of the Related Art

There is provided a roller cutter type roll paper cutter using a rotary knife for cutting roll paper such as a receipt which has been sent out from a platen.

In the conventional roller cutter type roll paper cutter, a rotary knife is attached to a carriage. A rail along which this carriage is moved also functions as a stationary knife. When the carriage moves on the rail which is fixed, roll paper is cut into sheets by the rotary knife and the rail, that is, roll paper is cut into sheets by the rotary knife and the stationary knife.

Therefore, it is necessary to arrange the components so that the rail, which also functions as a stationary knife, and the rotary knife come into contact with each other at all times. Accordingly, the degree of freedom of arranging the components is limited. As a result, it becomes difficult to replace the roll paper.

SUMMARY OF THE INVENTION

It is an object of the present invention to provide a roll paper cutter, the degree of freedom of arranging the components of which is large, so that the replacement of roll paper is not obstructed.

The present invention provides a roll paper cutter, for cutting roll paper which is fed out from a roll of paper so that it can be separated from an outer circumference of the roll of paper, comprising: a rail extending, in the longitudinal direction of the rail, perpendicular to the roll paper feeding direction; a stationary knife fixed at, and supported by, a carriage moving along the rail in the longitudinal direction of the rail; and a rotary knife pivotably supported by the carriage and rotated by coming into contact with the stationary knife when the carriage is moved wherein, when the carriage is moved in the longitudinal direction of the rail, a cutting edge intersection, formed by the rotary knife which is rotated by the movement of the carriage and also formed by the stationary knife, crosses and cuts the roll paper in the width direction.

The present invention may be more fully understood from the description of preferred embodiments of the invention set forth below, together with the accompanying drawings.

DESCRIPTION OF THE PREFERRED EMBODIMENTS

Referring to the accompanying drawings, embodiments of the roll paper cutter of the present invention will be explained as follows.

Figure 1:
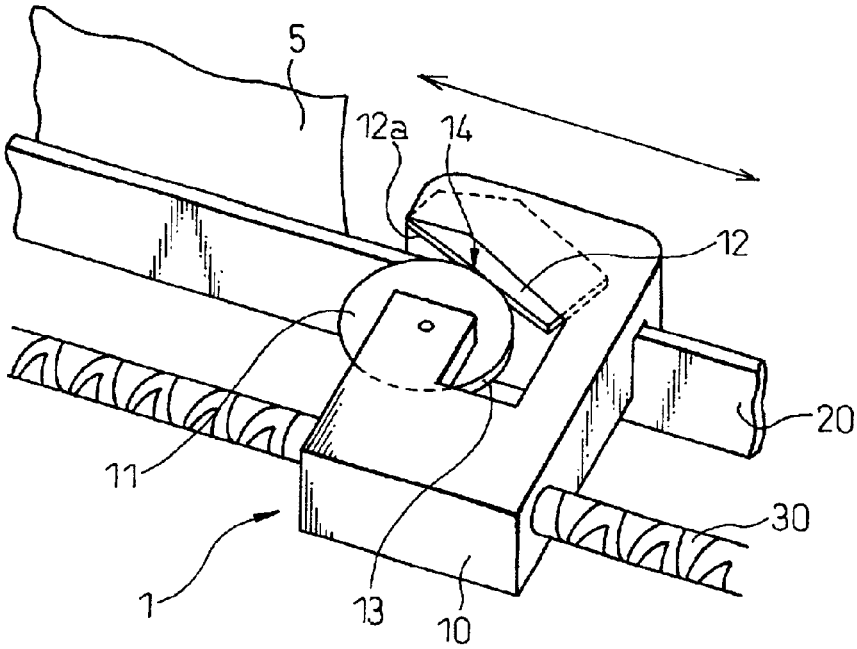
FIG. 1 is a perspective view for explaining the first embodiment of the roll paper cutter of the present invention.

FIG. 1 is a perspective view for explaining a characteristic portion of the roll paper cutter 1 of the first embodiment of the present invention. The roll paper cutter 1 includes a carriage 10 to which the rotary knife 11 and the stationary knife 12 are attached, and this carriage 10 is driven by the screw shaft 30 so that the carriage 10 can be moved along the rail 20 in the direction of an arrow.

The rotary knife 11 is attached to the same shaft as that of the guide roller 13 which travels on the rail 20. Therefore, the rotary knife 11 can be rotated simultaneously with the guide roller 13. On the other hand, the stationary knife 12 is attached obliquely with respect to the rail 20. The stationary knife 12 has a guide section 12*a*, which is arranged outside the rail 20 (in an upper portion of the drawing), for guiding the roll paper 5.

When the carriage is moved in the left upper direction in the drawing, the cutting edge intersection 14, formed between the rotary knife 11 and the stationary knife 12, is moved from the edge of the roll paper 5 in the width direction in such a manner that the stationary knife 12 crosses the roll paper 5. In this way, the roll paper 5 can be cut off by the cutting edge intersection 14. In this case, a portion of the stationary knife 12 outside the rail 20 (an upper portion of the stationary knife 12 in the drawing) functions as a guide section 12*a*. Therefore, this guide section 12*a* guides the roll paper 5 into the cutting edge intersection 14 formed between the rotary knife 11 and the stationary knife 12.

Figure 2:
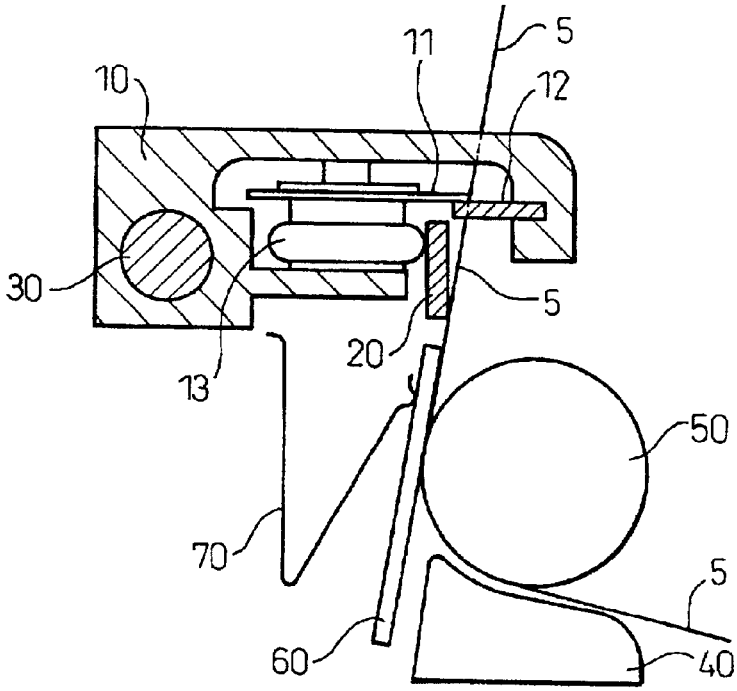
FIG. 2 is a cross-sectional view, taken on a cross-section which is perpendicular to the longitudinal axis of the rail, of the roll paper cutter shown in FIG. 1.

FIG. 2 is a cross-sectional view, taken on a section perpendicular to the longitudinal direction of the rail 20, for explaining the inner structure of the roll paper cutter 1. As shown in FIG. 2, the roll paper 5 passes through the paper guide 40. When the roll paper 5 passes the platen 50, printing is conducted on the roll paper 5 by the printing head 60, and then the roll paper 5 is cut into sheets by the cutter 1. In this connection, the printing head 60 is pressed to the platen by the spring 70.

Figure 3:
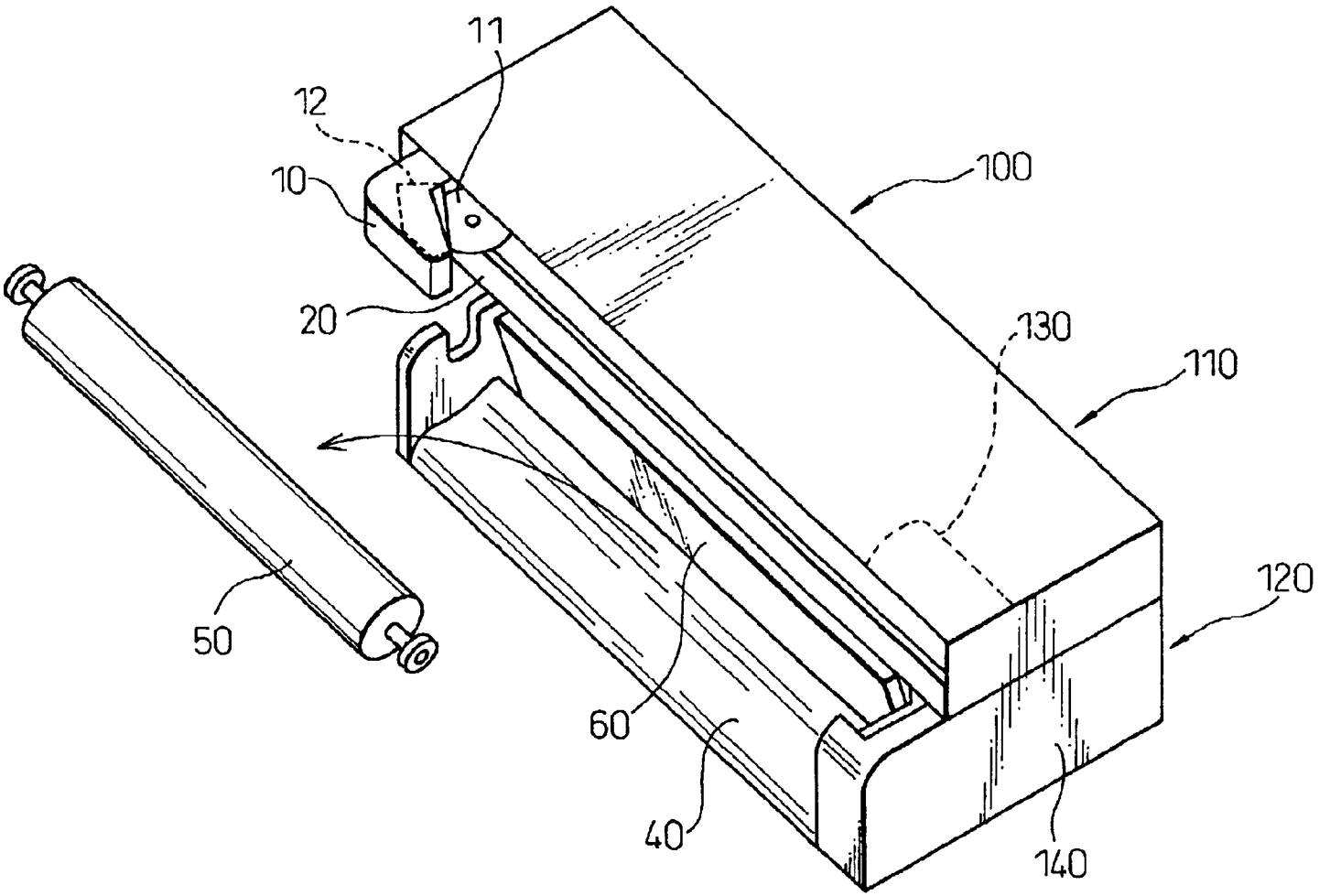
FIG. 3 is a view showing a printer into which the roll paper cutter shown in FIG. 1 is incorporated.

FIG. 3 is a perspective view showing a printer 100 in which the roll paper cutter 1 of the present invention is incorporated. The printer 100 includes an upper casing 110 and a lower casing 120. The rail 20 is attached to the upper casing 110, and the paper guide 40 and the platen 50 are attached to the lower casing 120. In this connection, the platen 50 can be easily attached to and detached from the lower casing 120 as shown in the drawing.

The motor 130 and the gear box 140 are attached to the lower casing 120. The torque of the motor 130 is transmitted to the screw shaft 30 via a gear train (not shown) arranged in the gear box 140. Also, the torque of the motor 130 is transmitted to the platen 50 which has been removed in this drawing.

Figure 4:
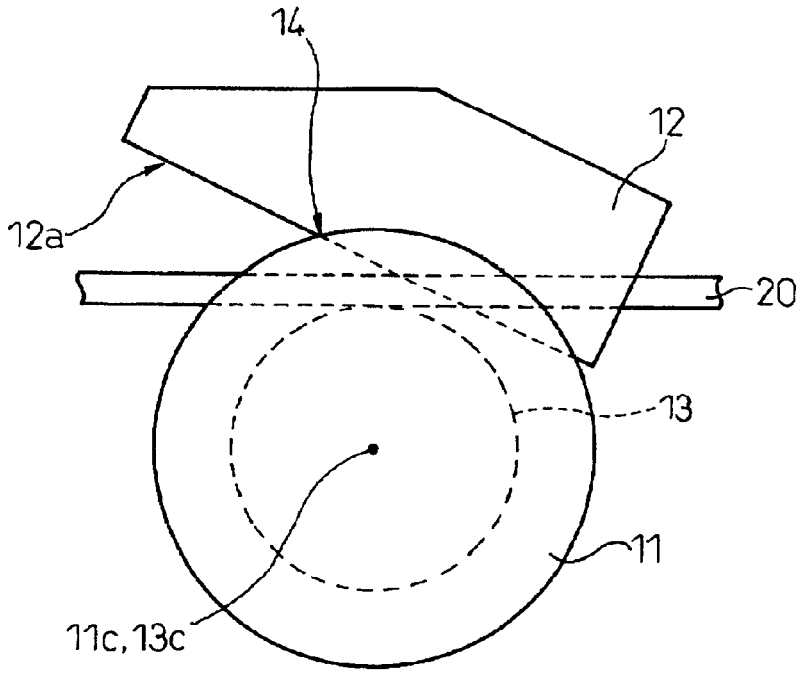
FIG. 4 is a view showing a relation between the rotary knife and the stationary knife of the roll paper cutter shown in FIG. 1.

FIG. 4 is a view showing the relation between the rotary knife 11, stationary knife 12 and rail 20. The profile of the rotary knife 11 shown in this drawing is a real circle, and the geometrical center 11*c* of the rotary knife 11 coincides with the rotary center 13*c* of the guide roller 13. Accordingly, the cutting edge of the rotary knife 11 always comes into contact with the cutting edge of the stationary knife 12 at the same position, that is, the cutting edge intersection 14 does not fluctuate.

Unless the position of the cutting edge intersection 14 fluctuates, there is a possibility that local abrasion of the stationary knife 11 occurs. In order to prevent local abrasion of the stationary knife 11 from occurring, the position of the cutting edge intersection 14 is made to fluctuate by the following variations.

Figure 5:
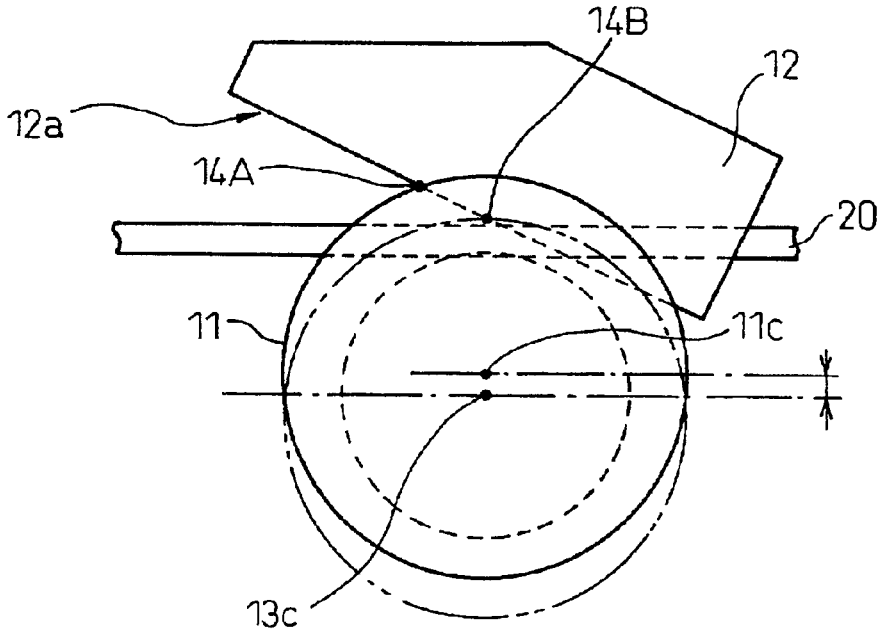
FIG. 5 is a view showing a relation between the rotary knife and the stationary knife of the roll paper cutter of the first variation of the first embodiment of the present invention.

In the first variation of the first embodiment shown in FIG. 5, the profile of the rotary knife 11 is a real circle, however, the geometrical center 11*c* of the rotary knife 11 is offset from the rotary center 13*c* of the guide roller 13. Due to the above arrangement, the cutting edge intersection 14 is reciprocated between 14A and 14B, that is, the cutting edge intersection 14 is not stopped. Therefore, local abrasion is prevented from occurring.

Figure 6:
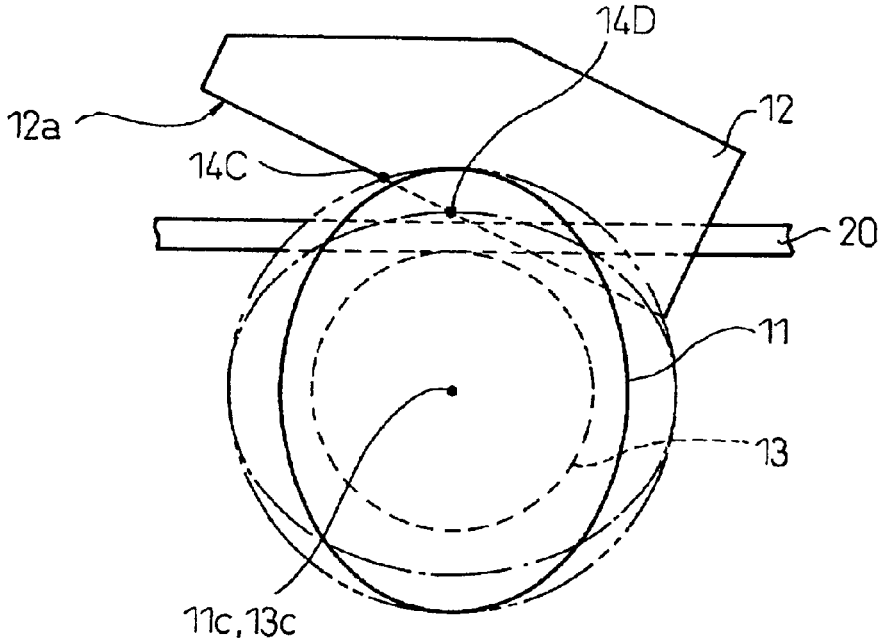
FIG. 6 is a view showing a relation between the rotary knife and the stationary knife of the roll paper cutter of the second variation of the first embodiment of the present invention.

In the second variation of the first embodiment shown in FIG. 6, the profile of the rotary knife 11 is an ellipse, and the geometrical center 11*c* of the rotary knife 11 coincides with the rotary center 13*c* of the guide roller 13. Due to the above arrangement, the cutting edge intersection 14 is reciprocated between 14C and 14D. Therefore, the local abrasion is prevented from proceeding.

Figure 7:
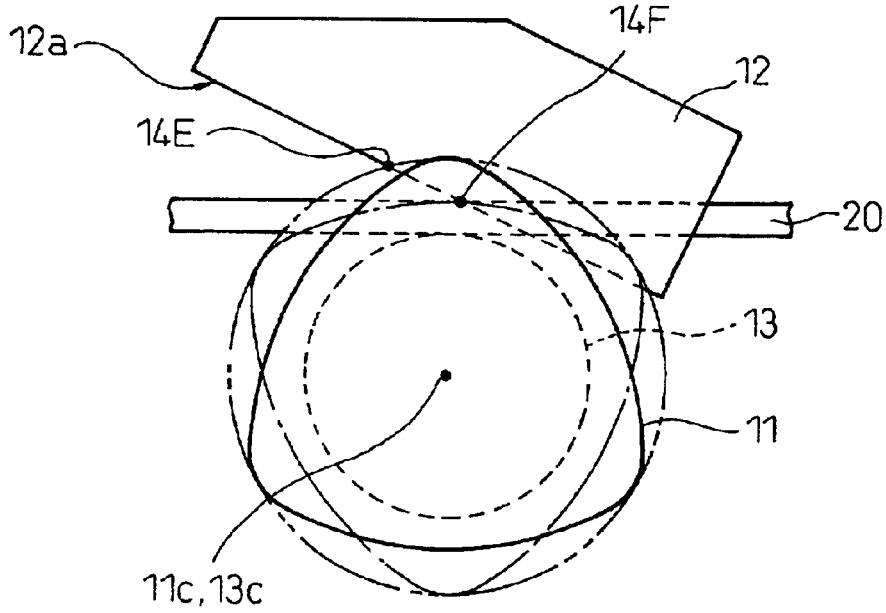
FIG. 7 is a view showing a relation between the rotary knife and the stationary knife of the roll paper cutter of the third variation of the first embodiment of the present invention.

In the third variation of the first embodiment shown in FIG. 7, the profile of the rotary knife 11 is a triangle, the corners of which are rounded, and the geometrical center 11*c* is made to coincide with the rotary center 13*c* of the guide roller 13. Due to the above arrangement, the cutting edge intersection 14 is reciprocated between 14E and 14F. Therefore, the local abrasion is prevented from proceeding.

Figure 8:
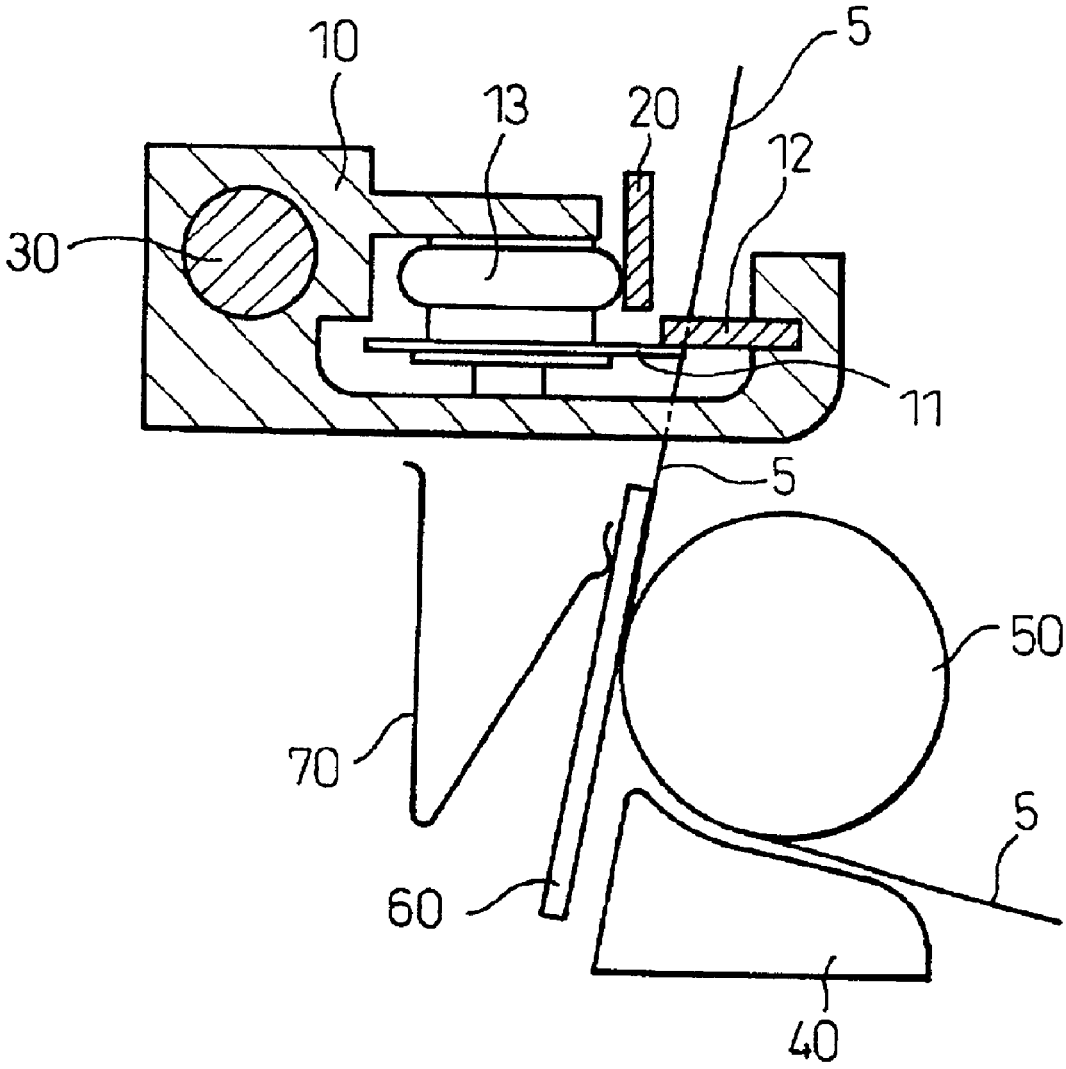
FIG. 8 is a cross-sectional view, taken on a cross-section which is perpendicular to the longitudinal axis of the rail, of the second embodiment of the roll paper cutter of the present invention.

FIG. 8 is a cross-sectional view showing the second embodiment. When the cross-sectional view showing the second embodiment is compared with the cross-sectional view of FIG. 2 showing the first embodiment, the carriage 10 is attached upside down. Therefore, the rotary knife 11 and the stationary knife 12 are arranged closer to the platen 50 than the rail 20. Due to the above arrangement, even if the roll paper 5 is strongly curled, the cutting edge intersection 14 is capable of positively catching an end portion of the roll paper 5 in the width direction.

According to the structure of the present invention, it is unnecessary for the rail to function as a stationary knife. Therefore, a large degree of freedom can be provided for designing the arrangement.

What is claimed is:

1. A roll paper cutter, for cutting roll paper which is fed out from a roll of paper so that the roll paper is separable from an outer circumference of the roll of paper, comprising:

a rail extending in a longitudinal direction of the rail perpendicular to a roll paper feeding direction;

a stationary knife fixed at and supported by a carriage moving along the rail in the longitudinal direction of the rail, the stationary knife being fixed at a non-zero angle with respect to the longitudinal direction of the rail, where an edge of the stationary knife is angled to a line along which it moves and the edge forms an acute angle with the roll paper when cutting the roll paper; and a rotary knife pivotally supported by the carriage and rotated and coming into contact with the stationary knife when the carriage is moved, wherein when the carriage is moved in the longitudinal direction of the rail, a cutting edge intersection formed by the rotary knife, which is rotated by the movement of the carriage, and also formed by the stationary knife crosses and cuts the roll paper in the width direction.

2. The roll paper cutter according to claim 1, wherein a position of the cutting edge intersection formed by the rotary knife and the stationary knife fluctuates.

3. The roll paper cutter according to claim 2, wherein a profile of the rotary knife is formed into a real circle, and a point of rotation of the rotary knife is offset from a center of the real circle so that the position of the cutting edge intersection fluctuates.

4. The roll paper cutter according to claim 2, wherein the position of the cutting edge intersection is made to fluctuate when a rotary knife, a profile of which is not a real circle, is rotated.

5. The roll paper cutter according to claim 4, wherein the profile of the rotary knife is elliptical.

6. The roll paper cutter according to claim 4, wherein the profile of the rotary knife is formed into a polygon, a number of sides of which is n (n>3).

7. The roll paper cutter according to claim 1, wherein the stationary knife has a guide section guiding an edge of the width direction of the roll paper to the cutting edge intersection.

8. The roll paper cutter according to claim 7, wherein the guide section between the roll paper and the stationary knife is arranged on a same side in a thickness direction of the rail.

9. The roll paper cutter according to claim 1, wherein the cutting edge intersection to cut the roll paper is arranged closer to the roll of paper than the rail.

10. The roll paper cutter according to claim 1, wherein the rotary knife is attached to a shaft of a guide roller traveling on a face of the rail.

11. The roll paper cutter according to claim 1, wherein the carriage is moved by a screw shaft rotated by a motor.

12. A roll paper cutter to cut roll paper, comprising:

a rail extending in a direction perpendicular to a roll paper feeding direction;

a carriage movable along the rail;

a stationary knife fixed at and supported by a carriage, the stationary knife being fixed at a non-zero angle with respect to a direction extending along the rail, where an edge of the stationary knife is angled to a line along which it moves and the edge forms an acute angle with the roll paper when cutting the roll paper; and a rotary knife pivotally supported by the carriage and rotated and coming into contact with the stationary knife when the carriage is moved such that when the carriage is moved along the rail, a cutting edge intersection is formed by the rotary knife and the stationary knife which crosses and cuts the roll paper in the direction perpendicular to the roll paper feeding direction.

* * * * *